US008297349B2

(12) United States Patent
Xu

(10) Patent No.: US 8,297,349 B2
(45) Date of Patent: Oct. 30, 2012

(54) OPENABLE PORT AND METHOD

(75) Inventor: Richard Y. Xu, Tomball, TX (US)

(73) Assignee: Baker Hughes Incorporated, Houston, TX (US)

( * ) Notice: Subject to any disclaimer, the term of this patent is extended or adjusted under 35 U.S.C. 154(b) by 398 days.

(21) Appl. No.: 12/693,525

(22) Filed: Jan. 26, 2010

(65) Prior Publication Data

US 2011/0180268 A1 Jul. 28, 2011

(51) Int. Cl.
*E21B 43/10* (2006.01)
*E21B 43/25* (2006.01)

(52) U.S. Cl. ..... 166/100; 166/194; 166/318

(58) Field of Classification Search ..... 166/100, 166/318, 194
See application file for complete search history.

(56) References Cited

U.S. PATENT DOCUMENTS 4,285,398 A 8/1981 Zandmer et al.
5,425,424 A 6/1995 Reinhardt et al.
7,021,389 B2 * 4/2006 Bishop et al. ..... 166/373
7,938,188 B2 5/2011 Richard et al.
8,104,538 B2 1/2012 Richard et al.
8,151,886 B2 4/2012 Xu et al.
2008/0142228 A1 6/2008 Harvey et al.
2011/0132612 A1 6/2011 Agrawal et al.

OTHER PUBLICATIONS

Notification of Transmittal of the International Search Report and the Written Opinion of the International Searching Authority; PCT/US2011/021863; Mailed Jul. 28, 2011; Korean Intellectual Property Office.

Casero, Alberto et al., "Transverse Multi-Fracture Technique in Kitina Highly Deviated Off-Shore Wells"; Society of Petroleum Engineers, SPE No. 113894, Jun. 9, 2008.

Casero, Alberto et al., "Continuous Pumping, Multistage, Hydraulic Fracturing in Kitina Field, Offshore Congo, West Africa"; Society of Petroleum Engineers, SPE No. 112442, Feb. 13, 2008.

Schnell, Rodney et al., "Montney Unconventional Gas—Next Generation, An Integrated Approach to Optimizing Wellbore Completions Technology"; Society of Petroleum Engineers, SPE No. 125970, Sep. 23, 2009.

* cited by examiner

*Primary Examiner* — Giovanna Wright
(74) *Attorney, Agent, or Firm* — Cantor Colburn LLP

(57) ABSTRACT

An openable port includes a body, a sleeve movable relative to the body, and a plug disposed at the sleeve that is extrudable through the sleeve. And the sleeve is substantially occluded to flow therethrough by the plug prior to extrusion of the plug and is open to flow therethrough after extrusion of the plug.

20 Claims, 3 Drawing Sheets

OPENABLE PORT AND METHOD

BACKGROUND

In fluidic systems, such as those used in the downhole drilling and completion industries, for example, devices and methods to allow a port that is initially closed to be subsequently opened are useful. It is also useful to have devices and methods that are able to move one component relative to another. Devices and methods, therefore, that allow an operator to perform both actions, relative movement of components and opening of a previously closed port, with a single input parameter are also useful.

BRIEF DESCRIPTION

Disclosed herein is an openable port. The port includes a body, a sleeve movable relative to the body, and a plug disposed at the sleeve that is extrudable through the sleeve. And the sleeve is substantially occluded to flow therethrough by the plug prior to extrusion of the plug and is open to flow therethrough after extrusion of the plug.

Further disclosed herein is a method of opening a port. The method includes, pressuring up to a first pressure against a plugged sleeve disposed at a body, moving the sleeve relative to the body, pressuring up to a second pressure against the plugged sleeve disposed at the body, and extruding a plug through the sleeve.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
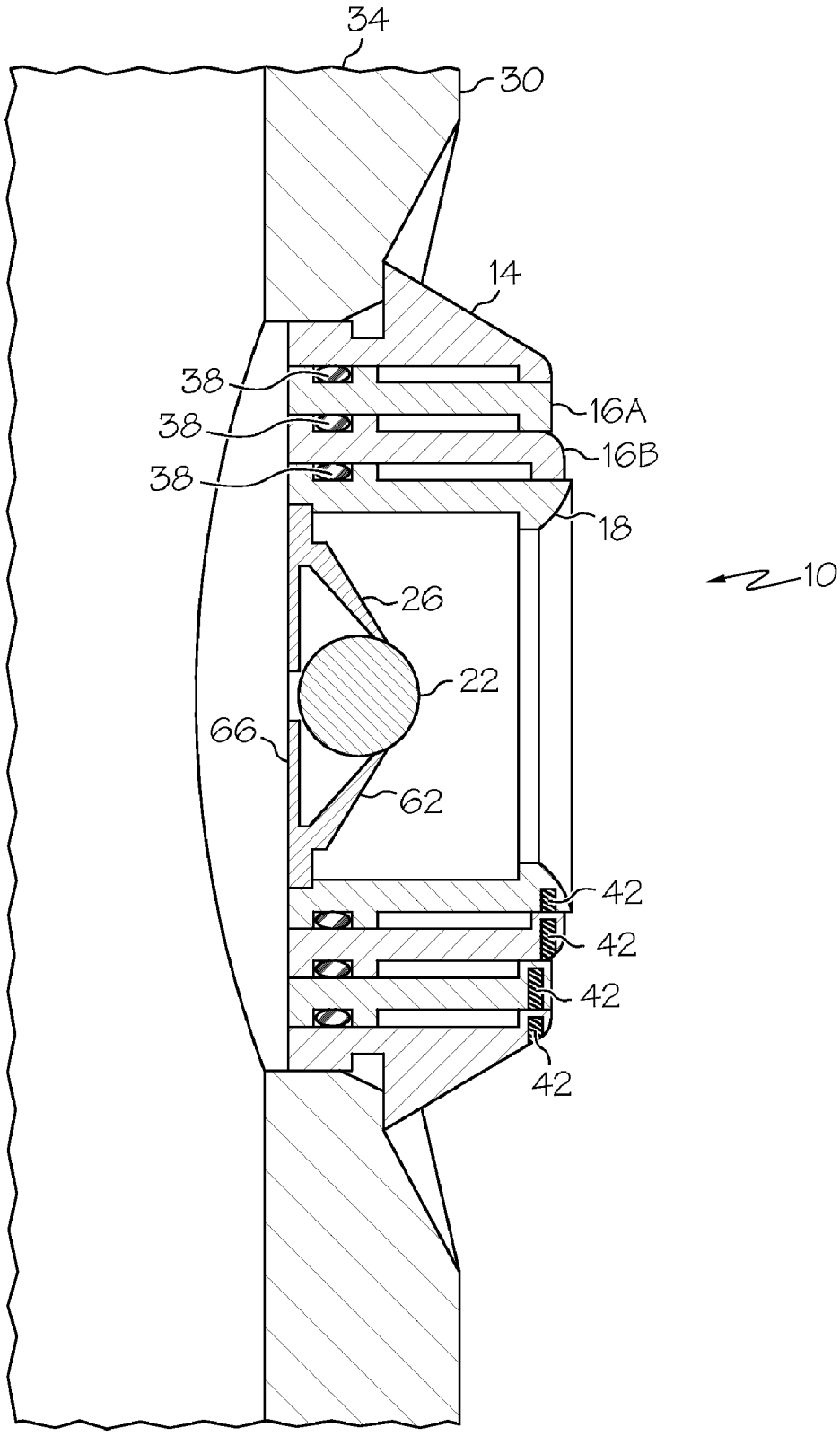
FIG. 1 depicts a cross sectioned view of an openable port disclosed herein shown in an un-extended and un-extruded position.
Figure 2:
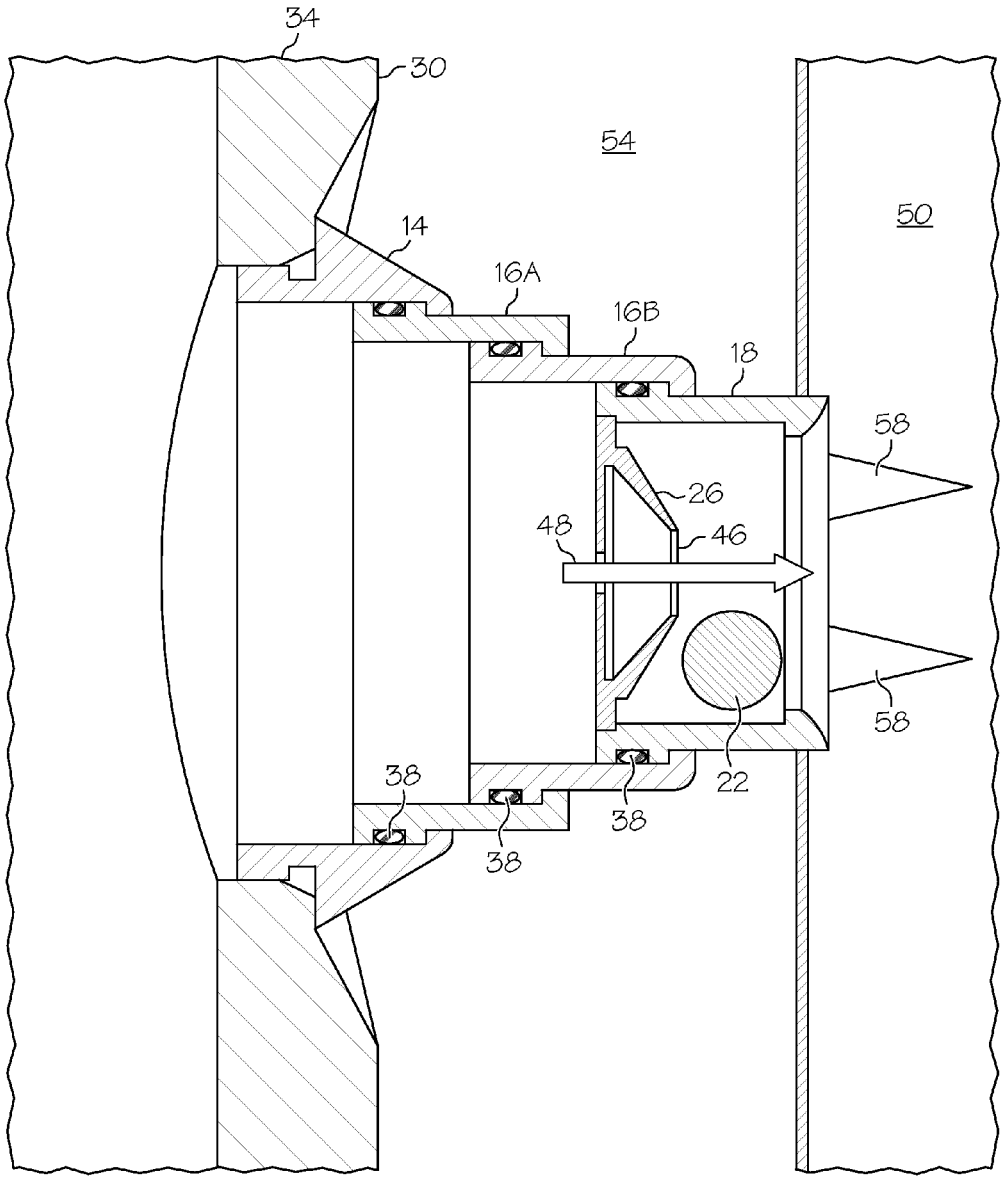
FIG. 2 depicts a cross sectioned view of the openable port of FIG. 1 shown in an extended and extruded position.

Referring to FIGS. 1 and 2, an embodiment of an openable port disclosed herein is illustrated generally at 10. The openable port 10 includes, a body 14, two collars 16A, 16B slidably engaged with the body 14, a sleeve 18 slidably engaged with the collar 16B, and a plug 22, seatingly engagable with a seat 26 on the sleeve 18. In this embodiment the body 14 is sealably fixed to a wall 30 of a tubular 34, such as a casing or well bore liner as is used in downhole hydrocarbon recovery or carbon dioxide sequestration industries, for example. Seals 38, illustrated herein as o-rings form seals between the body 14, collars 16A, 16B and the sleeve 18, while allowing them to slide relative to one another. The plug 22, shown here as a ball, seals against the seat 26 thereby allowing pressure to build thereagainst. At selected forces, established by frictional engagement between the body 14, collars 16A, 16B and the sleeve 18 (or optionally by force failing members 42, such as shear screws shown, for example), the sleeve 18 will move relative to the collar 16B, the collar 16B will move relative to the collar 16A, and the collar 16A will move relative to the body 14 (from the positions shown in FIG. 1 to the position shown in FIG. 2). Additionally, at a selected force the plug 22 will extrude through the sleeve 18 by either deforming the seat 26, deforming the plug 22 or deforming both the seat 26 and the plug 22, thereby opening a port 46 in the sleeve 18. Alternate embodiments are contemplated that have the sleeve 18 directly slidable engaged with the body 14 without the collar 16A or 16B located therebetween.

The foregoing structure allows an operator to perform several actions via the single action of pumping fluid. The several actions include: telescopically extending the sleeve 18 relative to the collar 16A, telescopically extending the collar 16B relative to the collar 16A, telescopically extending the sleeve 18 relative to the collar 16B and extruding the plug 22 through the sleeve 18. Upon completion of these actions, the operator can continue pumping fluid, which would then flow out of the tubular 34 in the direction of arrow 48 through the port 46 in the sleeve 18. The openable port 10 could be used in a downhole wellbore application, for example, where it is desired to pump proppant into a formation 50 where there is an open annular space 54 between the wall 30 of the tubular 34 and the formation 50. By extending the collars 16A, 16B and sleeve 18 radially beyond the body 14 the proppant can be pumped directly into openings 58 in the formation 50 where it is intended to be pumped rather than into the annular space 54. Although the embodiment disclosed herein includes the two collars 16A and 16B, alternate embodiments could employ more than two or fewer than two collars, depending upon the dimension of radial extension that is desired.

Forces required to extend the sleeve 18 and the collars 16A, 16B can be set to be less than a force required to extrude the plug 22 through the sleeve 18. This force relationship assures that the sleeve 18 and collars 16A, 16B extend before the plug 22 is extruded. Such a force relationship may be desirable since extruding the plug 22 first allows fluid within the tubular 34 to flow through the port 46 making building pressure to extend the sleeve 18 and collars 16A, 16B more difficult.

The body 14, collars 16A, 16B, sleeve 18 and plug 22 can all be made of metal, as can the seals 38. However, other materials may be used for any of these components including making the seals 38 and plug 22 of a polymeric material such as an elastomer to facilitate the sealing, sliding and extruding discussed above.

Figure 3:
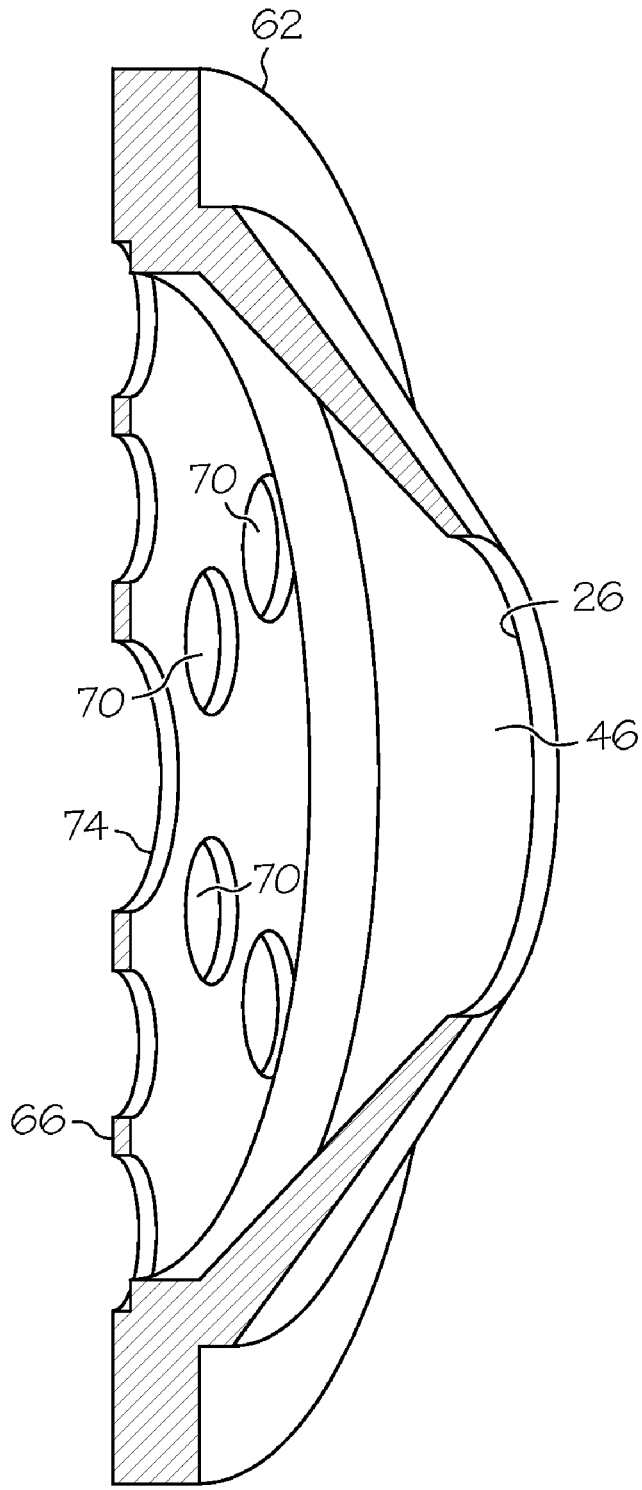
FIG. 3 depicts a partial cross sectioned perspective view of a support employed in the openable port of FIG. 1.

Referring to FIG. 3, the seat 26 can be integrally formed as part of the sleeve 18 or can be formed on a separate part such as a support 62 that is attached to the sleeve 18 by methods such as press fitting, welding and threadably engaging, for example. In this embodiment the support 62 includes the seat 26 and a plate 66 with one or more holes 70 therethrough that define flow passageways. The holes 70 allow fluid to flow therethrough and provide pressure against the plug 22 when seated against the seat 26 to build the forces needed to extrude the plug 22 through the port 36.

Additionally, the plate 66 includes an alignment feature 74 that aligns the plug 22 with the seat 26. The alignment feature 74 can be a hole through the plate 66 (as illustrated), an indentation in the plate 66, or a plurality of raised protrusions on the plate 66. The plate 66 can also include sufficient flexibility to act as a biasing member to hold the plug 22 against the seat 26 in a seated configuration to aid in developing pressure there against. Flexibility of the plate 66 can cause the openable port 10 to serve as a one way valve prior to extrusion of the plug 22 through the seat 26 by flexing to allow the plug 22 to move away from the seat 26 in response to a differential pressure across the openable port 10 being greater on an outside of the tubular 34 than on the inside of the tubular 34.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed:

1. An openable port comprising:

a body;

a sleeve movable relative to the body;

a seat being a single piece disposed at the sleeve defining a port; and a plug being seatingly disposed at the seat and movable through the seat upon deformation of the seat, the seat being substantially occluded to flow through the port by the plug prior to extrusion of the plug and being open to flow through the port after extrusion of the plug, the seat being configured to maintain the plug in seating engagement and sealed therewith at a first pressure sufficient to move the sleeve relative to the body and to allow the plug to move therethrough at a second pressure, the second pressure being greater than the first pressure and in a same direction as the first pressure.

2. The openable port of claim 1, wherein relative movement of the sleeve results in a portion of the sleeve being extended beyond the body.

3. The openable port of claim 1, wherein the sleeve is slidably sealed to the body.

4. The openable port of claim 1, further comprising at least one seal sealingly engaged with the body and the sleeve.

5. The openable port of claim 1, wherein at least one of the body and the sleeve are metal.

6. The openable port of claim 1, wherein the plug is a ball.

7. The openable port of claim 1, further comprising at least one collar movably engaged relative to both the body and the sleeve.

8. The openable port of claim 7, wherein the at least one collar is sealingly slidable engaged with at least one of the body and the sleeve.

9. The openable port of claim 7, wherein the relative movement of the at least one collar relative to the body allows a part of the collar to extend beyond the body and the relative movement of the at least one collar relative to the sleeve allows at least a portion of the sleeve to extend beyond the collar.

10. The openable port of claim 1, further comprising a support member configured to bias the plug against the seat.

11. The openable port of claim 10, wherein the support member includes at least one port open to flow therethrough while supporting the plug.

12. The openable port of claim 10, wherein the seat and the support are a single piece.

13. The openable port of claim 10, wherein the support allows the plug to unseat from the seat and allow flow through the port in response to pressure applied in a direction opposite that of the first pressure.

14. The openable port of claim 1, further comprising at least one force failing member engaged with both the body and the sleeve configured to maintain the sleeve relative to the body until failure thereof.

15. The openable port of claim 14, wherein the at least one force failing member fails at selected forces on the sleeve relative to the body.

16. The openable port of claim 1, wherein the movement of the sleeve relative to the body is along an axis of at least one of the body and the sleeve.

17. A method of opening a port, comprising:

pressuring up to a first pressure against a plug sealed against a seat being a single piece that defines a port disposed at a sleeve disposed at a body;

moving the sleeve relative to the body;

pressuring up to a second pressure against the plug sealed against the seat disposed at the sleeve disposed at the body in the same direction as the first pressure;

deforming the seat;

moving the plug through the seat; and opening the port.

18. The method of opening a port of claim 17, further comprising:

prior to the step of pressuring up to the second pressure performing the step of pressuring up to at least a third pressure against the plug sealed against the seat disposed at the sleeve disposed at the body; and moving a collar relative to the body.

19. The method of opening a port of claim 17, wherein the second pressure is greater than the first pressure.

20. The method of opening a port of claim 17, further comprising slidably sealing the sleeve relative to the body.

* * * * *